US006511128B2

(12) United States Patent
Piretti

(10) Patent No.: US 6,511,128 B2
(45) Date of Patent: Jan. 28, 2003

(54) CHAIR WITH SYNCHRONIZED ROCKING SEAT AND BACKREST

(75) Inventor: Alessandro Piretti, Bologna (IT)

(73) Assignee: Pro-Cord SpA, Bologna (IT)

( * ) Notice: Subject to any disclaimer, the term of this patent is extended or adjusted under 35 U.S.C. 154(b) by 30 days.

(21) Appl. No.: 09/876,852

(22) Filed: Jun. 7, 2001

(65) Prior Publication Data

US 2002/0005658 A1 Jan. 17, 2002

(30) Foreign Application Priority Data

Jun. 9, 2000 (IT) ..... T020A0558

(51) Int. Cl.[7] ..... A47G 1/032

(52) U.S. Cl. ..... 297/300.4; 297/302.3; 297/320

(58) Field of Search ..... 297/300.1, 300.3, 297/320, 302.3, 302.4

(56) References Cited

U.S. PATENT DOCUMENTS

| | | | | | |
|---|---|---|---|---|---|
| 1,491,918 | A | * | 4/1924 | Nolan | 297/320 |
| RE20,372 | E | * | 5/1937 | Lorenz | 297/300.2 |
| 2,529,726 | A | * | 11/1950 | Dorton | 16/386 |
| 4,575,150 | A | * | 3/1986 | Smith | 248/624 |
| 4,786,106 | A | * | 11/1988 | Bottemiller | 297/300.2 |
| 5,664,835 | A | * | 9/1997 | Desanta | 297/300.2 |
| 5,683,139 | A | * | 11/1997 | Golynsky et al. | 16/386 |
| 5,775,774 | A | * | 7/1998 | Okano | 297/300.4 |
| 5,810,440 | A | * | 9/1998 | Unwalla | 297/295 |
| 6,000,755 | A | * | 12/1999 | Uhlenbrock | 297/302.1 |

FOREIGN PATENT DOCUMENTS

| | | | | |
|---|---|---|---|---|
| IT | 264587 | * | 5/1929 | 297/300.2 |

* cited by examiner

*Primary Examiner*—Peter R. Crown
*Assistant Examiner*—Stephen D'Adamo
(74) *Attorney, Agent, or Firm*—Traskbritt, P.C.

(57) ABSTRACT

Chair with synchronized rocking seat and backrest, comprising:

a base support (14), a backrest supporting structure (18), connected to the base support (14) so to rock on a transversal axis (A), and a seat supporting structure (16) rocking on the base support (14) in a synchronized way with respect to the rocking movement of the backrest supporting structure (18).

The backrest supporting structure presents, on each side of the chair, a bent metallic rod comprising: an anchoring portion (26) fastened to the base support (14), a riser section (28) which extends upwards, and an elastically deformable area (30) permitting the riser section (28) to rock on the transversal axis (A) with respect to the anchoring portion (26). The seat supporting structure (16) presents, on each side of the chair, a metallic rod (56) comprising: an anchoring portion (58) fastened to the base support (14), a lower section (60), an upper section (64) and an elastically deformable connecting portion (62) arranged between the lower section (60) and the upper section (64). Connection devices (84, 85) are provided between the upper section (64) and the seat supporting structure (16) and the backrest supporting structure.

5 Claims, 6 Drawing Sheets

CHAIR WITH SYNCHRONIZED ROCKING SEAT AND BACKREST

This invention relates to a chair with synchronised rocking seat and backrest. More precisely the invention relates to a chair of the type comprising:

a base support, a backrest supporting structure connected to the base support so to rock on a transversal axis, and a seat supporting structure rocking on the base support in a synchronised way with respect to the rocking movement of the backrest supporting structure.

In chairs of this sort, the mechanism for obtaining synchronised rocking of the seat and the backrest is usually complex, large and formed by a high number of components.

The purpose of this invention is to provide a chair of the type specified above, which is simple, comfortable and which cost is low.

According to this invention, this purpose is attained by a chair, having the features forming the subject of the claims.

This invention will be better explained by the following detailed descriptions with reference to the accompanying drawings, given as non-limiting example, wherein.

Figure 1:
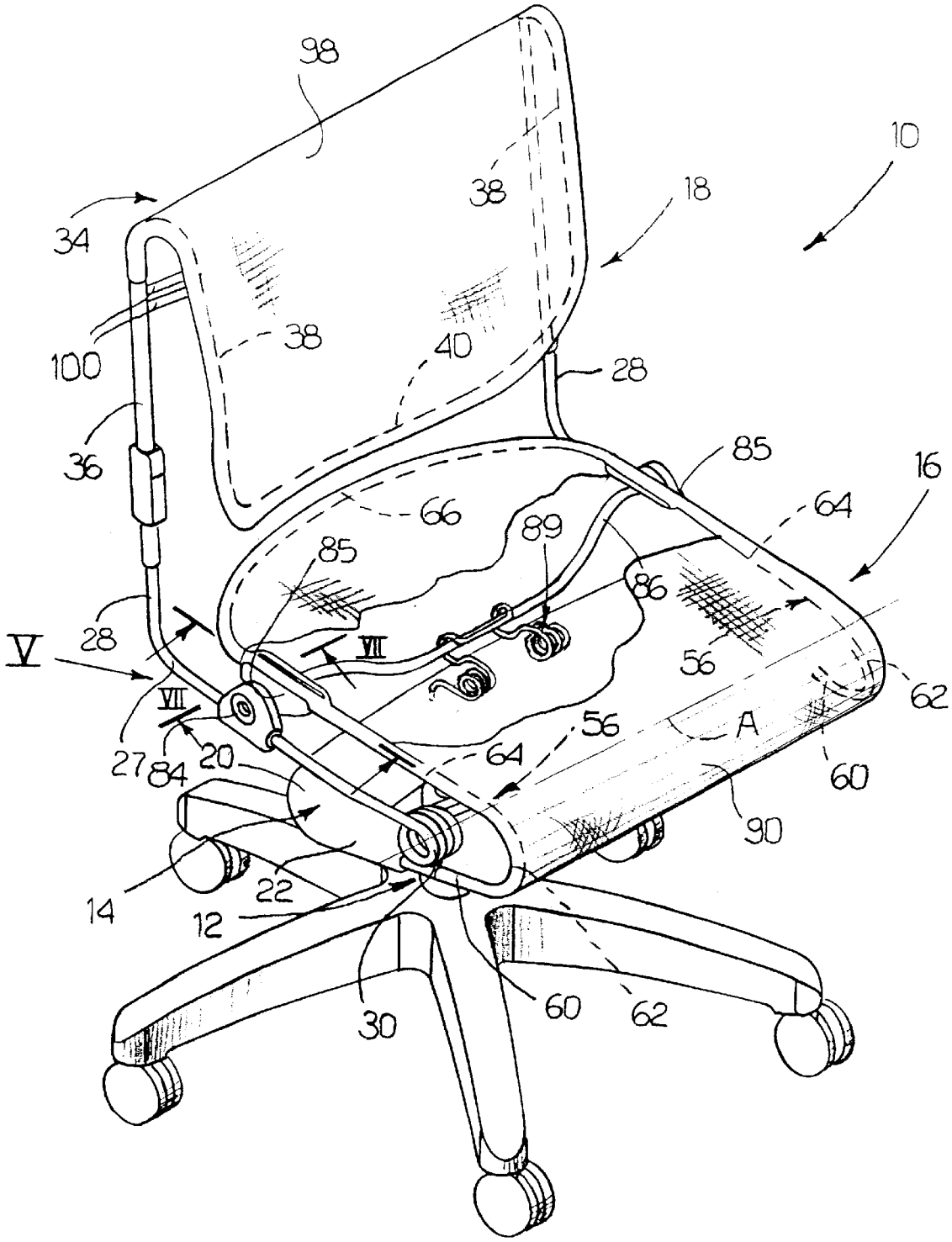
FIG. 1 is a perspective view of a chair according to this invention.
Figure 2:
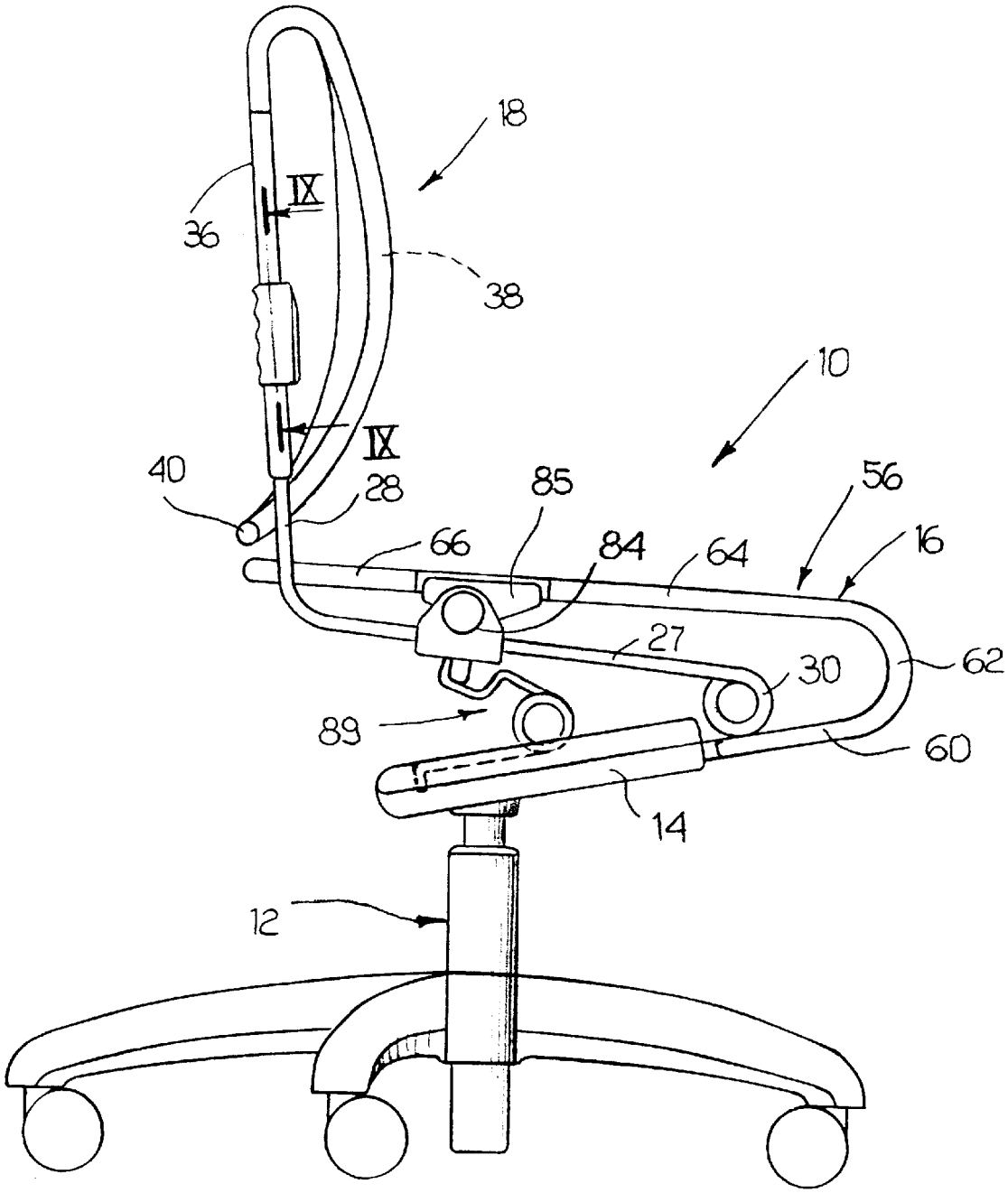
FIG. 2 is a lateral view of the chair shown in FIG. 1.
Figure 3:
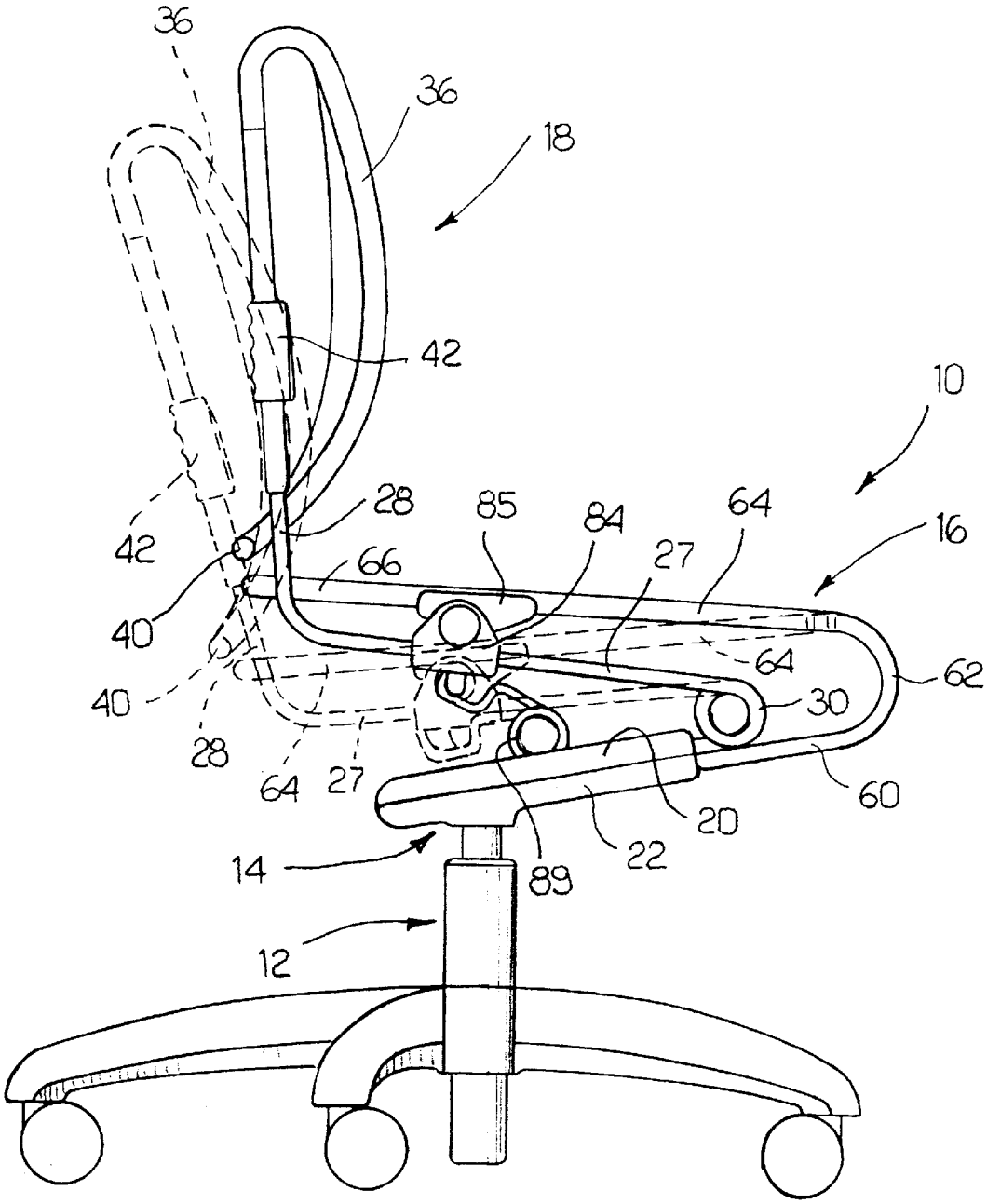
Figure 4:
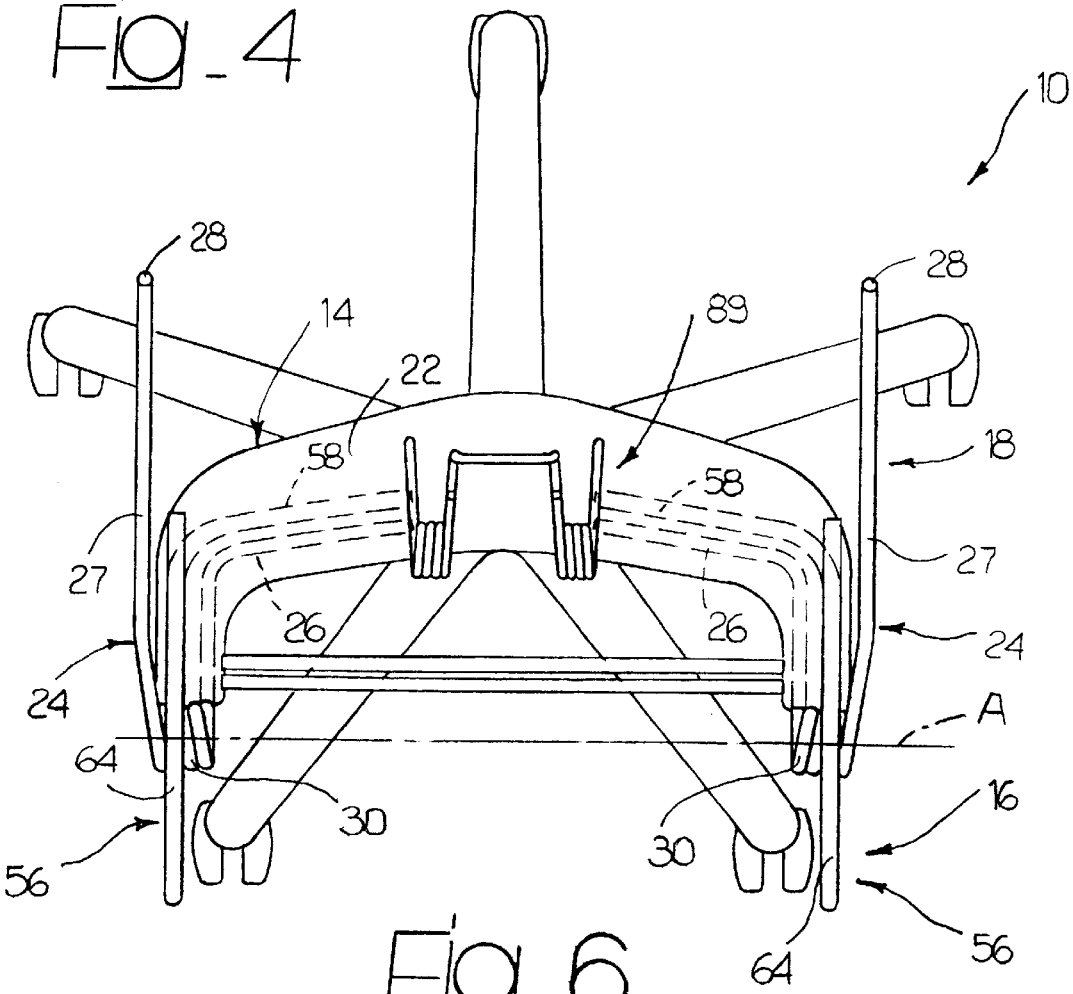
Figure 6:
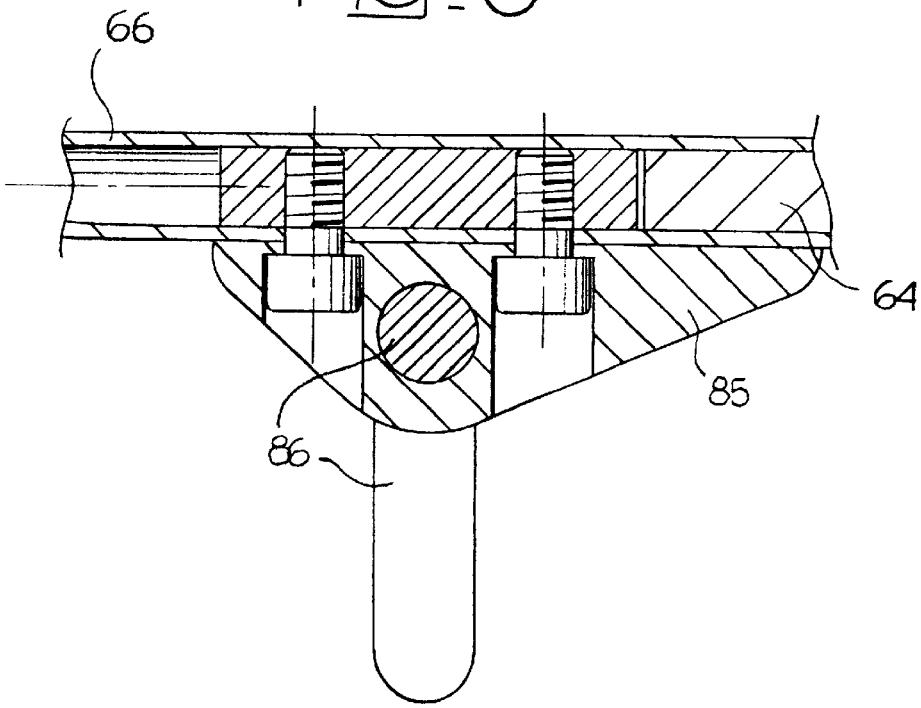
Figure 5:
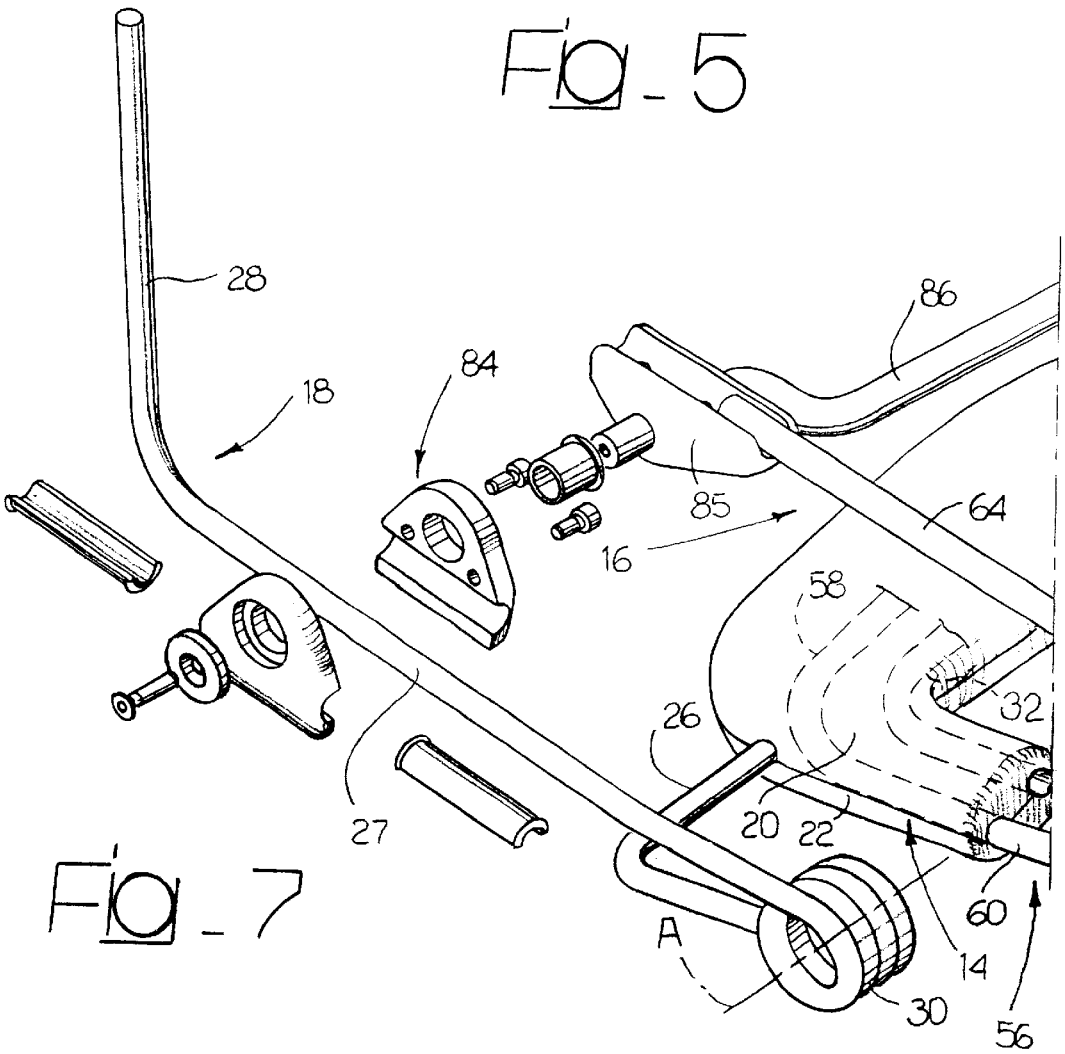
Figure 7:
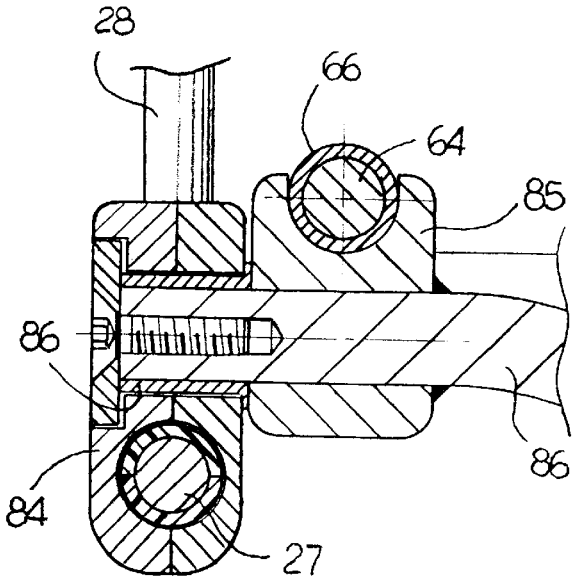
Figure 8:
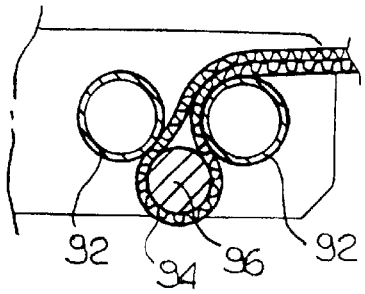
Figure 9:
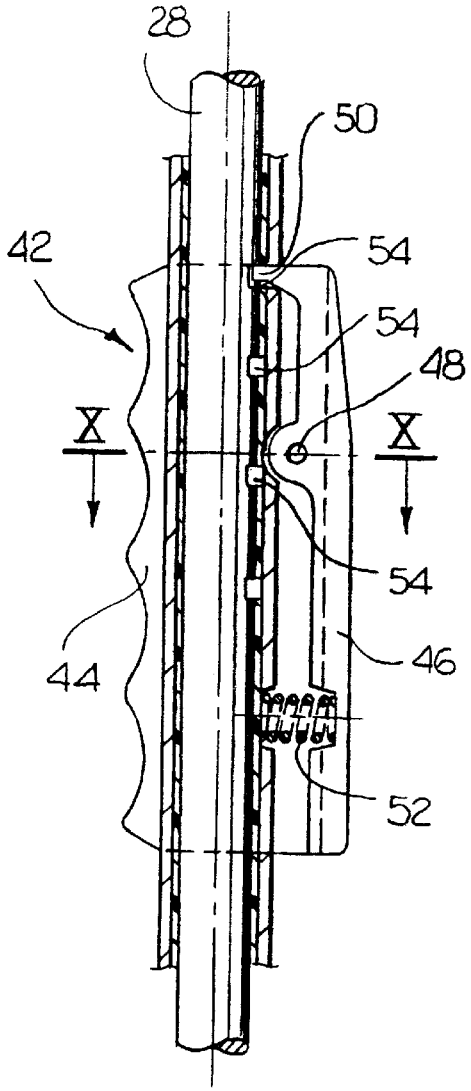
Figure 10:
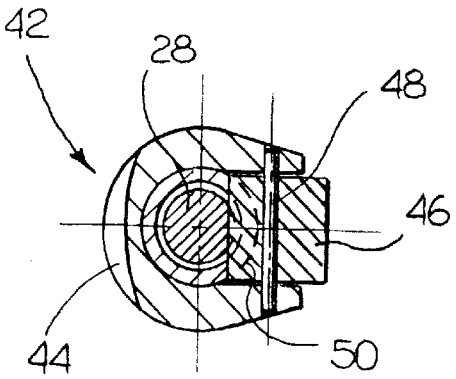

FIG. 3 is a lateral view illustrating the synchronised rocking movement of the seat and the backrest of the chair according to this invention, FIG. 4 is a partial top view of the chair shown in FIG. 1, without the seat and backrest cover, FIG. 5 is a perspective exploded view of the part indicated by the arrow V in FIG. 1, FIGS. 6 and 7 are cross-sections according to lines VI—VI and VII—VII in FIG. 1, FIG. 8 is a blown-up detail of the part shown by the arrow VII in FIG. 2, FIG. 9 is a cross-section according to line IX—IX in FIG. 2, and FIG. 10 is a cross-section according to line X—X in FIG. 9.

With reference to figures from 1 to 4, numeral 10 indicates a chair comprising a central support 12, which height can be adjusted. A base support 14 is connected to the top of the central support 12. The support 14 is in turn connected to the seat supporting structure 16 and to the backrest supporting structure 18. The base support 14 is essentially made of a pair of overlapping, reciprocally fastened metallic casings 20, 22. The lower casing 20 is fastened to the upper part of the central support 12 and the upper casing 22 is fastened to the lower casing 20, for example by means of screws (not illustrated).

The seat supporting structure 16 and the backrest supporting structure 18 are formed by respective metallic rods, respectively shaped as described below. The seat supporting structure 14 and the backrest supporting structure 18 are both symmetric with respect to a vertical plane. For this reason, only one side of the chair will be described, being understood that the opposite side is perfectly symmetrical.

The backrest supporting structure 18 comprises, on each side of the chair, a metallic rod 24, which presents an anchoring portion 26 (FIG. 4), an elastically deformable area 30, a straight section 27, which extends towards the rear of the chair from the elastically deformable area 30 and a riser section 28. The anchoring portion 26 is secured to the base support 14. Preferably, it is secured by fastening the anchoring portion 26 between the casings 20, 22. These casings are equipped with counterpoised housings 32 (FIG. 5), between which the anchoring portion 26 is housed and anchored. The elastically deformable section is arranged on the front of the base support 14 and the riser section 28 extends upwards from a rear extremity of the straight section 27. The elastically deformable area 30 of each metallic rod 18 is shaped so to permit the rocking of the straight section 27 and the riser section 28 with respect to the anchoring portion 26 on a transversal axis A, located in the front of the base support 14. In the example shown in the figures, the elastically deformable area 30 is shaped as a cylindrical helix, which is coaxial to the rocking axis A and presents an number of turns sufficient to obtain the required degree of elasticity for the backwards rocking of the backrest on the axis A.

The backrest supporting structure 18 comprises a frame 34, consisting of a metallic tubular element folded so to obtain two straight sections 36, two arched sections 38 and a transversal straight section 40. The two straight sections 36 of the frame 34 slide on the respective riser sections 28. The frame 34 comprises a pair of locking devices 42 arranged on the straight sections 36 and suitable for withholding the frame 34 in a selected position. As visible in the FIGS. 9 and 10, each blocking device 42 comprises a sleeve 44, connected to a rocker arm 46, hinged to the sleeve 44 on a transversal axis 48. The rocker arm 46 presents an engagement portion 50, which is pushed towards the metallic rod 28 by a coil spring 52. Each riser section 28 presents a set of notches 54, destined to be engaged in the engagement portion 50, as shown in FIGS. 9 and 10. The vertical position of the frame 34 with respect to the riser sections 28 can be changed by gripping the sleeves 42 and pressing the levers 46, whereby contrasting the action of the respective springs 52, so to release the retainer devices 42. After releasing the retainer devices 42 in this way, the frame 34 can slide in the vertical direction upwards and downwards and be fastened in a position selected by releasing the lever 46.

The supporting structure of the seat 16 comprises, on each side of the chair, a metallic rod element 56, which presents an anchoring portion 58, a lower lateral section 60, an elastically deformable connecting portion 62 and an upper section 64, which extends in the longitudinal direction along one side of the chair. The rear parts of the upper sections 64 are joined by a frame formed by a tubular element 66 bent in the shape of a U. The anchoring portion 58 is secured to the base support 14. This is secured by fastening the base portion 58 between the casings 20, 22. These casings are equipped with counterpoised housings holding the anchoring portion 58. The fitting area is shaped so that the upper sections 64 can rock with respect to the lower sections 60.

The upper section 64 of the seat supporting structure 16 on each side of the chair is fastened by means of a bracket 85 to an extremity of a reinforcement crossbar 86. Each extremity of the crossbar 86 is connected to a shoe 84, which is free to slide along the straight section 27 of the backrest supporting structure 18. As shown in FIGS. 6 and 7, each shoe 84 is articulated to a respective extremity of the crossbar 86. The turning connection between the shoe 84 and the crossbar 86 is obtained by means of a bushing 88.

As shown in FIG. 3, the backwards rocking movement of the backrest supporting structure 18 on the axis A causes the shoe to slide along the straight section 27 and the seat supporting structure 16 to rock backwards. The rocking movements of the seat supporting structure 16 and the backrest supporting structure 18 are reciprocally synchronised by effect of the reciprocal connection obtain by means of the shoes 84.

A reinforcement spring 89 is interposed between the crossbar 85 and the base support 14. The reinforcement spring has two L-shaped extremities, which are inserted inside specific holes of the support. A knob equipped with an eccentric control unit (not illustrated) can be provided for adjusting the elastic resistance of the spring 89.

With reference to FIG. 1, the seat supporting structure 16 holds a layer of fabric 90 pulled between the upper sections 64 of the supporting structure 16. Preferably, the fabric 90 consists of a tubular element which is inserted on the supporting structure 16 from the back. The tubular fabric element 90 is anchored along a front edge to the seat supporting structure 16 or to the base support 14. As shown in FIG. 8, the base support has a pair of transversal parallel rods 92 between which a terminal portion 94 of the tubular fabric element 90 is inserted. The terminal part 94 is anchored to the transversal rods 92 by inserting a rod 96 inside the terminal portion 94.

The frame 34, which can slide vertically on the backrest supporting structure 18, holds a tubular fabric element 98 taut along the arched sides 38 of the frame 34. The tubular element 98 is inserted on the frame 34 from the lower edge and is anchored along an upper edge between a pair of transversal rods 100 as described above with reference to FIG. 8. Preferably, the lateral edges of the tubular elements 90 and 98 are sewn after being inserted on the seat supporting structure and the frame 34.

What is claimed is:

1. Chair with synchronised rocking seat and backrest, comprising:

a base support (14), a backrest supporting structure (18), connected to the base support (14) so to rock on a transversal axis (A), and a seat supporting structure (16) rocking on the base support (14) in a synchronised way with respect to the rocking movement of the backrest supporting structure (18), characterized in that the backrest supporting structure presents, on each side of the chair, a bent first metallic rod comprising: an anchoring portion (26) fastened to the base support (14), a riser section (28) which extends upwards, and an elastically deformable area (30) permitting the riser section (28) to rock on said transversal axis (A) with respect to the anchoring portion (26), and in that the seat supporting structure (16) presents, on each side of the chair, a second metallic rod (56) comprising: an anchoring portion (58) fastened to the base support (14), a lower section (60), an upper section (64) and an elastically deformable connecting portion (62) arranged between the lower section (60) and the upper section (64), and that connection devices (84, 85) are provided between the upper section (64) of the seat supporting structure (16) and the backrest supporting structure.

2. Chair according to claim 1, characterized in that said connection devices comprises, on each side of the chair, a shoe (84), which can freely slide on the straight section of the backrest supporting structure (18).

3. Chair according to claim 1, characterized in that the backrest supporting structure (18) comprises a frame (34), which position can be adjusted vertically along the riser sections (28) of the backrest supporting structure.

4. Chair according to claim 3, characterized in that said frame (34) of the backrest supporting structure (18) holds a tubular fabric element (98) taut between two arched lateral sections (38).

5. Chair according to claim 1, characterized in that the seat supporting structure (16) holds a tubular fabric element (90) taut between said upper sections (64) on each side of the chair.

* * * * *